US009056479B2

(12) United States Patent
Stathem et al.

(10) Patent No.: US 9,056,479 B2
(45) Date of Patent: Jun. 16, 2015

(54) PRESSURE BAG

(75) Inventors: Ralph Stathem, Lebanon, OR (US); Mark C. Donning, Corvallis, OR (US); James C. Hall, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/876,152

(22) PCT Filed: Oct. 27, 2010

(86) PCT No.: PCT/US2010/054357

§ 371 (c)(1), (2), (4) Date: Mar. 26, 2013

(87) PCT Pub. No.: WO2012/057755

PCT Pub. Date: May 3, 2012

(65) Prior Publication Data

US 2013/0201263 A1 Aug. 8, 2013

(51) Int. Cl.
*B41J 2/175* (2006.01)
*B41J 2/17* (2006.01)

(52) U.S. Cl.
CPC ..... *B41J 2/17506* (2013.01); *Y10T 29/49401* (2015.01); *B41J 2/17513* (2013.01); *B41J 2002/17516* (2013.01); *B41J 2/17559* (2013.01)

(58) Field of Classification Search
CPC ..... B41J 2/17513; B41J 2002/17516; B41J 2/17503; B41J 2/17559; B41J 2/17506
USPC ..... 347/84, 85, 86
See application file for complete search history.

(56) References Cited

U.S. PATENT DOCUMENTS

| | | | | |
|---|---|---|---|---|
| 5,917,523 | A | 6/1999 | Baldwin et al. | |
| 5,975,686 | A | 11/1999 | Hauck et al. | |
| 6,050,682 | A | 4/2000 | Pawlowski, Jr. | |
| 6,213,598 | B1 | 4/2001 | Hou et al. | |
| 6,220,702 | B1 | 4/2001 | Nakamura et al. | |
| 6,739,710 | B2 | 5/2004 | Lin et al. | |
| 6,866,374 | B2 | 3/2005 | Taku | |
| 6,874,873 | B2 | 4/2005 | Thielman et al. | |
| 7,093,710 | B2 | 8/2006 | Shimizu et al. | |
| 7,556,365 | B2 | 7/2009 | Stathem | |
| 7,618,135 | B2 | 11/2009 | Stathem et al. | |
| 2002/0047883 | A1 | 4/2002 | Hou et al. | |
| 2003/0122908 | A1 | 7/2003 | Lin | |
| 2003/0142180 | A1 * | 7/2003 | Gonzales | 347/86 |
| 2007/0222829 | A1 | 9/2007 | Stathem | |

FOREIGN PATENT DOCUMENTS

| | | | |
|---|---|---|---|
| EP | 0633137 | A2 | 1/1995 |
| EP | 1093922 | A1 | 4/2001 |
| EP | 1541358 | A2 | 6/2005 |
| TW | 520709 | | 2/2003 |
| TW | I221123 | | 9/2004 |

* cited by examiner

*Primary Examiner* — Jannelle M Lebron
(74) *Attorney, Agent, or Firm* — Hewlett-Packard Patent Department

(57) ABSTRACT

A pressure bag for in a fluid cartridge having an opening in open connection with a channel in a wall of the fluid cartridge.

20 Claims, 11 Drawing Sheets

PRESSURE BAG

BACKGROUND OF THE INVENTION

In printers, print heads are provided to fire droplets of ink onto print media. The fluid is provided in a cartridge. The cartridge may be separately provided from the print head, or may be integrated with the print head. In many cases, the cartridge is a consumable supply that can be exchanged with respect to the printer. In some cases, the cartridge is arranged to be refilled, for example while being mounted in the printer.

The pressure in the cartridge needs to be carefully controlled well because it has an effect on the fluid flow into and/or out of the print head. In turn, this may have an effect on fluid drop characteristics, which is one of the most important parameters of image quality.

BRIEF DESCRIPTION OF THE DRAWINGS

For the purpose of illustration, certain embodiments of the present invention will now be described with reference to the accompanying diagrammatic drawings, in which.

DETAILED DESCRIPTION

In the following detailed description, reference is made to the accompanying drawings. The embodiments in the description and drawings should be considered illustrative and are not to be considered as limiting to the specific embodiment of element described. Multiple embodiments may be derived from the following description and/or drawings through modification, combination or variation of certain elements. Furthermore, it may be understood that also embodiments or elements that are not literally disclosed may be derived from the description and drawings by a person skilled in the art.

In most cartridges a certain back pressure is present in its inner volume to control the fluid flow. "Backpressure" may be understood as a pressure that is lower than the atmospheric pressure, which inhibits fluid from leaking out of the cartridge. If the cartridge lacks sufficient back pressure, ink may leak from the print head. On the other hand, if the backpressure is excessive, the nozzles may not fire properly. The back pressure is carefully controlled by a back pressure controlling mechanism present in the cartridge.

A known type of cartridge uses a porous member that is mounted in the fluid volume to absorb the fluid. Here, a back pressure effect is obtained by the capillary characteristics of the porous member. One disadvantage of this arrangement is that the porous member consumes space within the volume of the cartridge.

Another arrangement for controlling pressure and back pressure within a cartridge, and that tends to consume less space than a porous member, is an arrangement of a pressure bag and bias spring. The cartridge and the bag have an opening in its walls for permitting ventilation between the bag and an exterior of the cartridge. For example, this allows atmospheric air to enter into the bag. The bag is arranged to inflate or deflate within the cartridge in response to a pressure change inside or outside of the cartridge. When the bag is inflated in the cartridge, the bias spring presses against the bag to partly deflate the bag, which causes a small amount of back pressure. The bag construction is also used for priming the printer, wherein the bag is actively hyperinflated and deflated causing rapid pressurization for priming.

Figure 1:
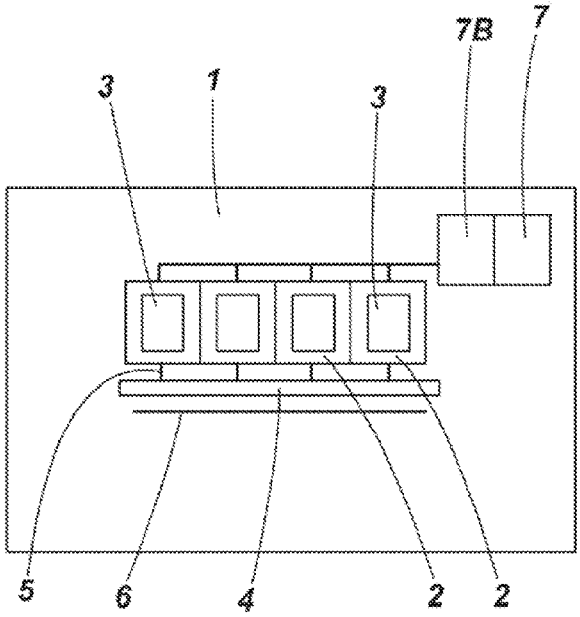
FIG. 1 shows a diagram of an embodiment of a printer with cartridges mounted therein in front view.
Figure 2:
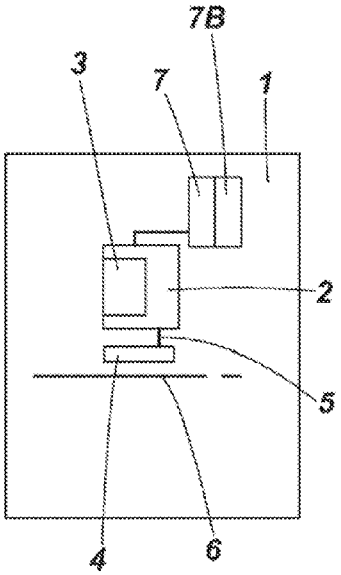
FIG. 2 shows a diagram of the embodiment of the printer of FIG. 1 in side view.

FIGS. 1 and 2 show an embodiment of a fluid ejection device 1. The fluid ejection device 1 may comprise a printer. The printer may be an inkjet printer, for example a thermal inkjet, a piezo inkjet, or a continuous inkjet printer. The fluid ejection device 1 comprises one or more receiving structures 2 for receiving and exchanging fluid cartridges 3. In the shown embodiment, the fluid ejection device 1 comprises multiple receiving structures 2 for receiving multiple respective cartridges 3. Each cartridge 3 may comprise a different fluid. In the shown embodiment each cartridge 3 comprises a specific ink color, for example a cyan, magenta, yellow, black and/or grey. The cartridges 3 are arranged to be exchanged with respect to the receiving structure 2.

Figure 5:
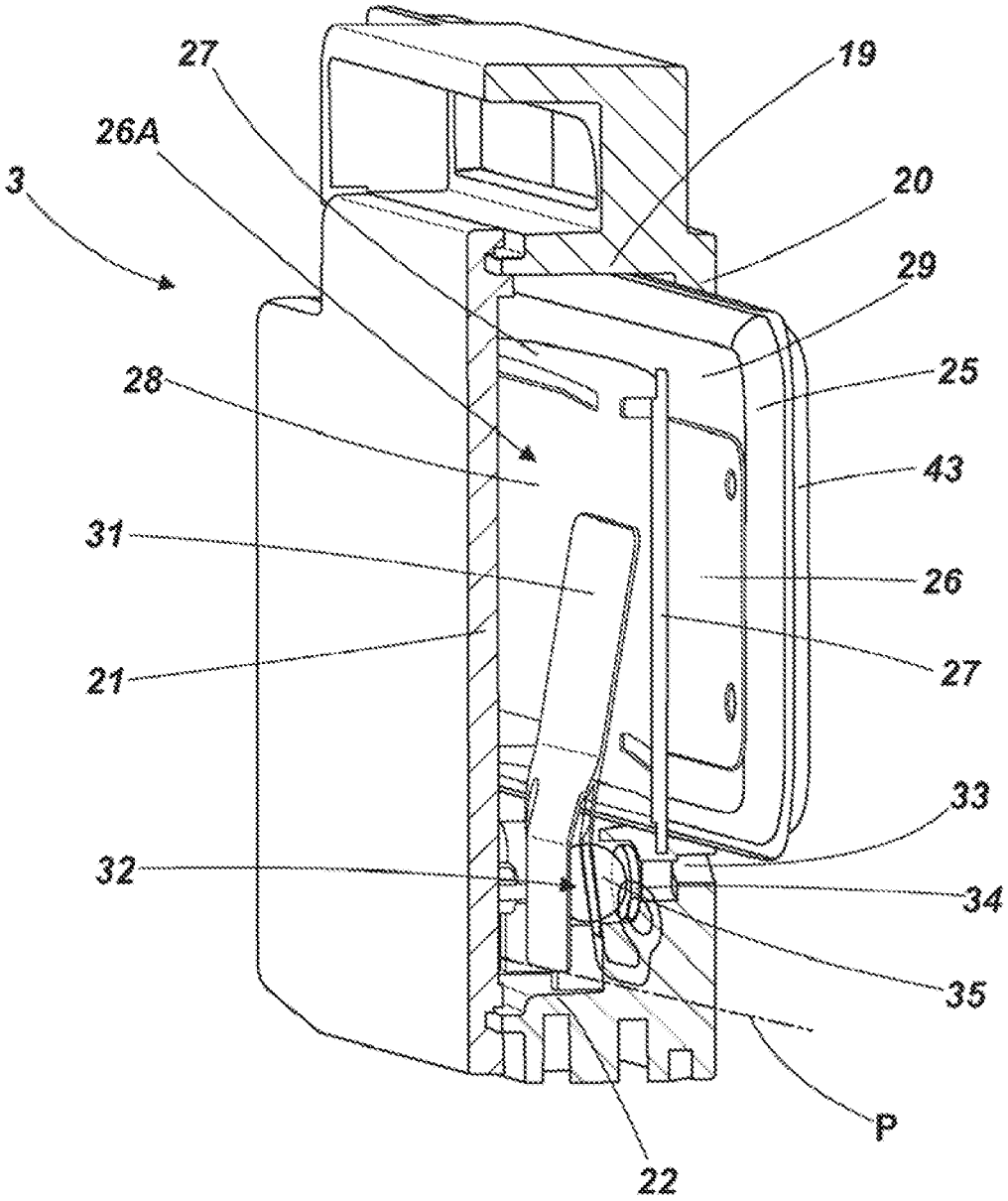
FIG. 5 shows a perspective, partly cross sectional view of an embodiment of a cartridge.
Figure 6:
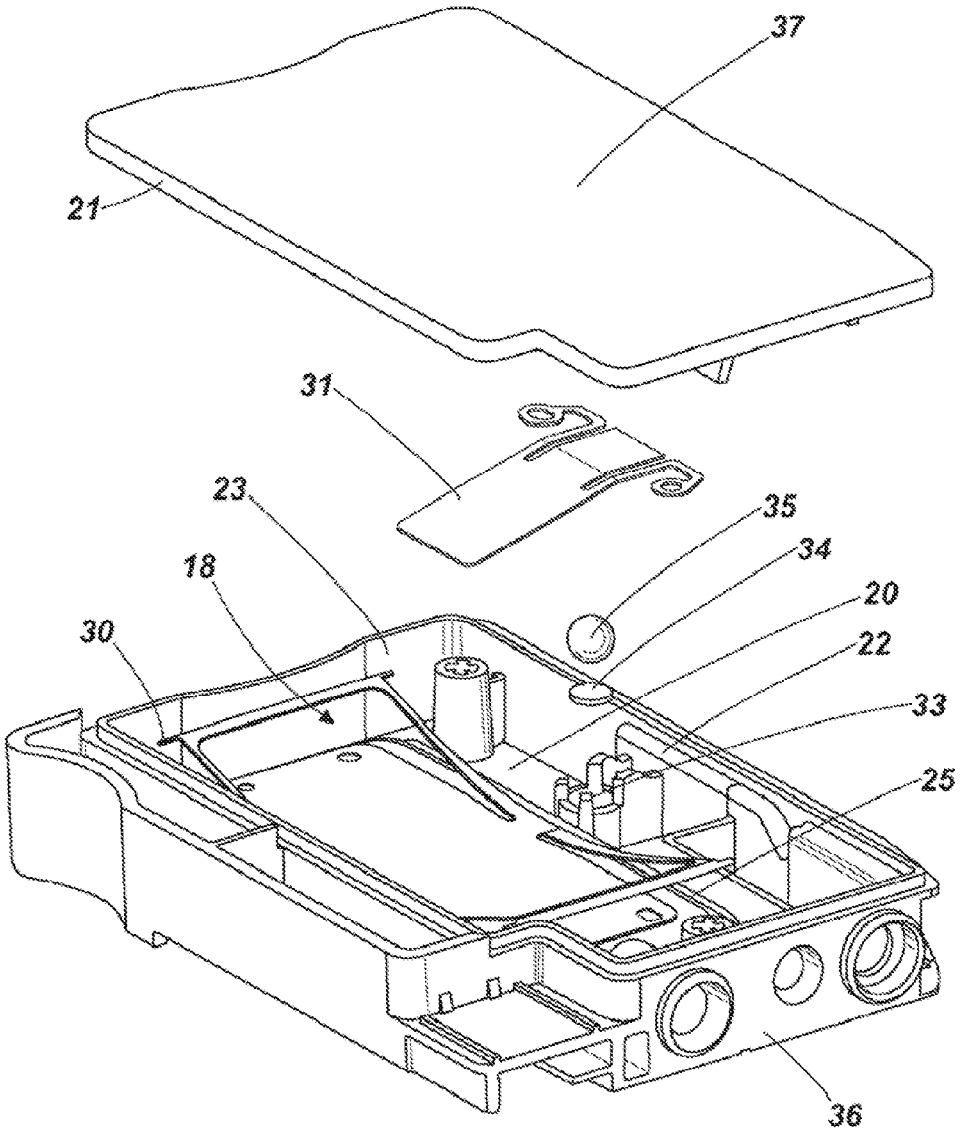
FIG. 6 shows an exploded view of an embodiment of the cartridge of FIG. 5.
Figure 7:
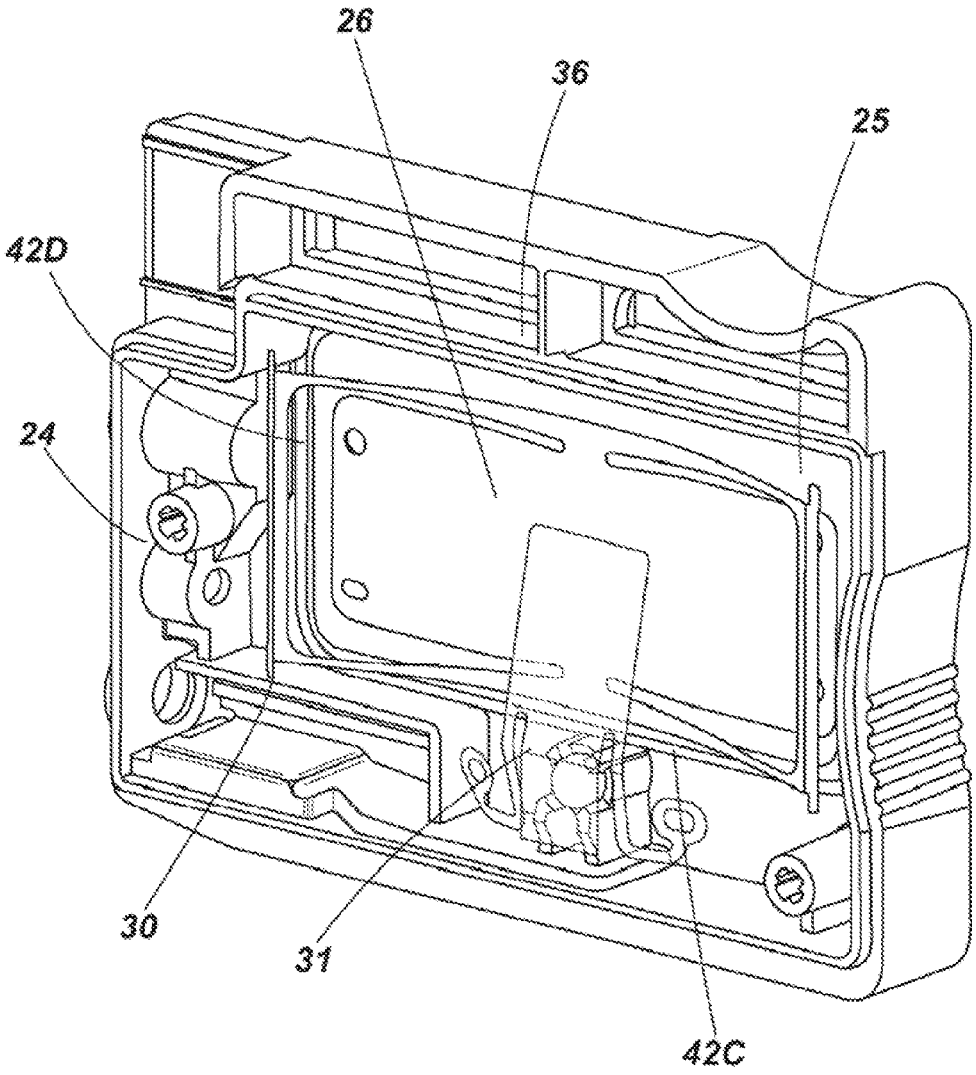
FIG. 7 shows a perspective, cross sectional view of the embodiment of a cartridge of FIGS. 5 and 6.

The cartridge 3 comprises an inner volume 18 for holding fluid. The inner volume 18 is defined by cartridge walls 19-24 (FIGS. 5-7). The receiving structures 2 are arranged to connect the cartridge 3 to the print head 4. A fluid supply 5 is provided to receive fluid from the respective cartridges 3, and deliver the fluid to the print head 4.

The receiving structure 3 is arranged to establish a fluidic interface between the cartridge 3 and the fluid supply 5. The receiving structures 2 may be arranged off axis and/or on axis. The print head 4 may comprise a scanning print head 4 or a page wide array print head 4 (PWA). In the shown embodiment, the fluid ejection device 1 comprises an off axis system with a PWA, wherein the receiving structure 2 and the cartridges 3, when installed, have a fixed position with respect to the fluid ejection device 1. During printing a print medium 6 extends under the print head 4.

The fluid ejection device 1 is further provided with a control circuit 7 and a memory 7B. The receiving structure 2 and the cartridge 3 may comprise an electrical interface for connecting the respective cartridge 3 to the control circuit 7.

Figure 3:
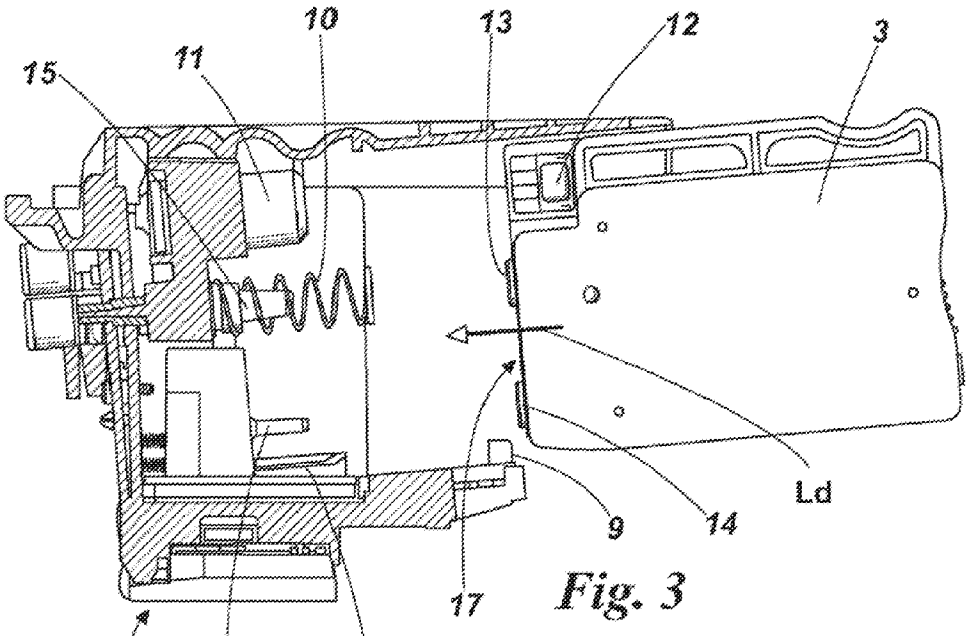
FIG. 3 shows an embodiment of a cartridge and a cartridge receiver in cross sectional side view.

FIG. 3 shows an arrangement of a receiving structure 2 and a fluid cartridge 3. The receiving structure 2 is part of a printer (not shown). In the shown embodiment, the receiving structure 2 and the cartridge 3 comprise multiple interconnecting interfaces.

A mechanical interface is provided for connecting the cartridge 3 to the receiving structure 2, so that the fluidic and electrical interfaces are connected. The mechanical interface may be arranged to allow lateral insertion of the cartridge 3, in a lateral direction Ld, so that the fluidic and electrical interfaces on the front face 17 of the cartridge 3 connect to corresponding interfaces of the receiving structure 2. For example, the receiving structure 2 may comprise a guide 8 for guiding the cartridge 3 into the receiving structure 2. The cartridge 3 may comprise a corresponding slide arrangement in its bottom (not visible in figures). In the shown embodiment the guide 8 comprises a T-rail. The receiving structure 2 may comprise a latch 9 for locking the cartridge 3 to the receiving structure 2, by engaging a corresponding notch (not shown) in the cartridge 3. A release mechanism 10 may be provided, for releasing and/or pushing out the cartridge 3 when the latch 9 is unlocked. Furthermore, the receiving structure 2 may comprise an electrical interface 11, of which only the backside is shown In FIG. 3, for connection to a cartridge electrical interface 12, for establishing an electrical connection between the cartridge 3 and the control circuit 7.

The fluid cartridge 3 is provided with two fluidic interfaces 13, 14 for connection with two corresponding fluidic interfaces 15, 16 of the receiving structure 2. As shown in FIG. 3, the cartridge fluidic interfaces 13, 14 may be arranged on the front face 17. A first cartridge fluidic interface 13 is adapted to allow a first fluid to flow through. The first cartridge fluidic interface 13 is arranged to mate with a corresponding first receiving fluidic interface 15 of the receiving structure 2. These first fluidic interfaces 13,15 fluid tightly interconnect for guiding a first fluid into and/or out of the cartridge 3. A second cartridge fluidic interface 14 is arranged to mate with a corresponding second receiving fluidic interface 16. The second interfaces 14, 16 are arranged to guide a second fluid into and/or out of the cartridge 3. In an embodiment, the first fluid comprises a pressure fluid and the second fluid comprises a liquid, for example ink. The pressure fluid may comprise gas, for example ambient air. In use, the pressure fluid inflates and deflates a pressure bag in the cartridge 3, for controlling a pressure of the second fluid in the inner volume 18 of the cartridge 3.

Figure 4A:
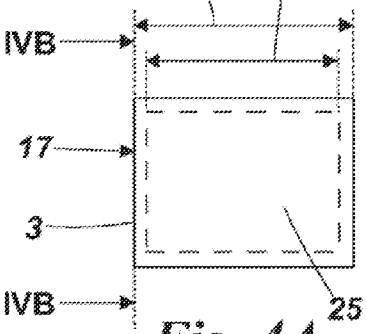
FIGS. 4A and 4B diagrammatically illustrate the contours of an embodiment of a cartridge, in side view and in front view, respectively.

As can be seen from FIGS. 4A and B, the fluid cartridge 3 may have a relatively thin shape. The thin shape may be realized by the synergetic design of the interfaces, including the mechanical interface, and the interior mechanisms of the cartridge 3, which will be explained into further detail below. For example, the fluid cartridge 3 may have a length L versus width W ratio of at least approximately 4:1, or at least approximately 5:1, or at least approximately 6:1, respectively. In an embodiment the length L is approximately 72.5 millimeter and the width W is approximately 13.5 millimeter. In other words, the width W of the cartridge 3 may be at least approximately four times less than the length L of the cartridge 3, or at least approximately five times or six times less than the length L of the cartridge 3. In this disclosure, the length L, width W and height H of the cartridge 3 are measured according to the outer contours of the cartridge 3, as can be seen from FIGS. 4A and 4B. The length L, width W and height H are measured along directions that are perpendicular to each other, like a 3 dimensional axes system. In a further embodiment, a height H versus width W ratio may be at least approximately 3:1, respectively. For example the height H is approximately 42 millimeter while the width W is approximately 13.5 millimeter. A thin cartridge 3 may save space in the fluid ejection device 1, have less material costs, and/or may ultimately also lead to a relatively smaller and/or flatter fluid ejection device 1. A thin cartridge 3 may be easier to hold by hand and to manually connect to the receiving structure 2.

FIG. 5 shows a cross section of an embodiment of a cartridge 3 in perspective view. The cartridge's inner volume 18 is shown. The inner volume 18 is defined by cartridge walls 19-24 (FIGS. 5-7). A second fluid is contained in the inner volume 18. A first fluid is contained in a pressure bag 25, when the pressure bag 25 is at least partially inflated. In this embodiment the first fluid is a pressure fluid and the second fluid comprises ejection fluid such as ink.

The pressure bag 25 has a fluidic connection with the first cartridge fluidic interface 13. In an installed position of the cartridge 3, the pressure fluid such as air is guided through the first cartridge fluidic interface 13 into and out of the bag 25. A channel 39 (FIG. 8) may connect the bag 25 to the first cartridge fluidic interface 13. In certain embodiments, the channel 39 may connect directly to an exterior of the cartridge 3. In this embodiment, the exterior comprises ambient air.

Figure 4B:
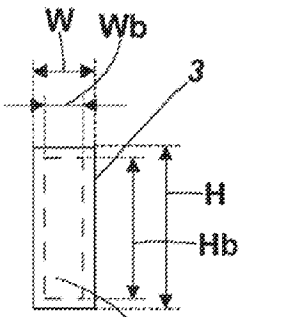

In an inflated condition, the bag 25 may have a relatively small width Wb, following the thin shaped inner volume 18 of the cartridge 3, as diagrammatically illustrated in dashed lines in FIGS. 4A and 4B. The length Lb or height Hb of the bag 25 versus the width Wb of the bag 25 may be at least approximately 3:1, or at least approximately 4:1, or at least approximately 5:1, respectively, in a maximally inflated condition within the cartridge 3.

The bag 25 is arranged to maintain a certain approximate back pressure in the inner volume 18. In an embodiment, the bag 25 functions as a part of a pressure accumulator arrangement that prevents that the back pressure becomes too low, preventing dripping of fluid out of the cartridge 3 and/or print head nozzles. As a part of a pressure accumulator, the bag 25 reacts to changes in pressure, for example due to changes in temperature and/or pressure outside and/or inside of the cartridge 3, for example by letting air out of the bag 25 when the cartridge inner pressure increases relative to an outer pressure. In a further embodiment, the bag 25 may function as a part of a pressure regulation arrangement by preventing a back pressure from becoming too high, which may be caused by fluid ejecting out of the cartridge 3 and/or changes in temperature and/or pressure. The pressure regulator arrangement may allow fluid, such as air and/or ink, to enter in the inner volume 18 of the cartridge 3. Furthermore, the bag 25 may function as a part of a priming arrangement, by being arranged to hyper-inflate, in that way rapidly increasing an inner pressure of the cartridge 3. As a part of a priming arrangement, the bag 25 may be connected to a pump (not shown), for example through the first fluid interfaces 13, 15. In an embodiment, the cartridge 3 comprises a pressure regulation, a pressure accumulation and a priming arrangement. An embodiment wherein the bag 25 functions as a part of an integrated pressure regulation, pressure accumulation and priming arrangement is explained below.

In an embodiment, the integrated pressure accumulator, pressure regulator and priming arrangement comprises a bag 25, a resilient element 26A, a lever 31 and a valve 32. The cartridge 3 may comprise a resilient element 26A in its volume to provide a resilient force against the bag 25. In use, the bag 25 may suck in pressure fluid to compensate for a decrease in pressure. For example, the bag 25 would inflate by ambient air until the pressure in the bag 25 is approximately the same as the ambient air at the cartridge exterior. The resilient element 26A prevents the bag 25 from expanding too far by pushing against the bag 25. The resilient element 26A thereby maintains a certain backpressure in the inner volume 18. Such mechanism may prevent leaking of the nozzles. The resilient element 26A and the bag 25 are adapted to maintain the back pressure at a suitable level, providing for a pressure accumulation arrangement.

In the shown embodiment, the resilient element 26A comprises a leaf spring 26. The leaf spring 26 may be relatively flat. The leaf spring 26 may be arranged between and/or against a side wall 21 of the cartridge 3 and the bag 25. The leaf spring 26 may comprise at least one or at least two bias legs 27 that bias the spring 26 towards the bag 25. The spring 26 may comprise an engagement surface 28 for engaging the bag. 25. In the shown embodiment, the spring 26 comprises two opposite pre-biased curved legs 27 that are arranged around the outer contour of the engagement surface 28 of the spring 26. The legs 27 may be curved in a surface perpendicular to said side wall 21, to bias the spring 26 away from the side wall 21. The curves in the legs 27 are adapted so that the leaf spring 26 exerts a relatively constant force against the bag 25 relatively independent of the depression of the spring 26. The engagement surface 28 may have a relatively large surface for engaging a relatively large portion of one of the two surfaces 29, 43 of the bag 25. For example at least 40% of the surface 29 of the bag 25 may engage the engagement surface 28 of the spring 26, at least in an at least partially deflated condition of the bag 25. For example, in the embodiment shown in FIG. 5 the engagement surface 28 engages at least approximately 50% of the surface 29 of the bag 25. The engagement surface 28 engages the surface 29 of the bag 25 without being attached to the bag 25. This may provide for relatively easy assembly of the spring 26 and the bag 25 in the cartridge 3. The bias legs 27 are attached to said engagement surface 28. In other embodiments, instead of a leaf spring 26A with curved legs 27, the resilient element 26A may include other types of legs or resilient members attached to an engagement surface 28 for providing a resilient force against the bag 25.

A further feature of the leaf spring 26 may include at least one gripping extension 30 for gripping and assembling the leaf spring 26. In the shown embodiment, the spring 26 comprises four gripping extensions 30, one at each outer corner of the respective legs 27. During assembly, at least one gripping extensions 30 may be attached to the lid, and placed inside the cartridge 3, against the bag 25, as is shown in FIG. 6. The extensions 30 provide make a more efficient assembly of the cartridge 3 possible. The gripping extensions 30 may comprise protrusions or pins.

In the shown embodiment, a lever 31 is provided that may pivot approximately around a pivot axis P. The lever 31 may engage a valve 32 that seals a third fluidic interface 33. The valve 32 may comprise a rubber disk 34 that closes off the third fluidic interface 33 and a contact ball 35 between the lever 31 and the disk 34. The third fluidic interface 33 may be connected to an air and/or ink supply, for allowing further air and/or ink to stream into the inner volume 18. In one embodiment, the fluid ejection device 1 comprises on and/or off axis fluid cartridges, and in use, ink may be provided through the third fluidic interface 33. In another embodiment, the fluid ejection device 1 comprises on and/or off axis fluid cartridges, and in use, air may be provided through the third fluidic interface 33.

The lever 31 is moved by inflating or deflating the bag 25. In a deflated condition of the bag 25, the lever 31 may push against the valve 32 so as to seal the third fluidic interface 33. In an inflated condition of the bag 25, the lever 31 may release the valve 32 with respect to the third fluidic interface 33 because the bag 25 moves the lever 31 away from the third fluidic interface 33. Here, the valve 32 may acts as a pressure regulator and/or a check valve. In the shown embodiment the lever 31 engages the engagement surface 28 of the spring 26. Inflation or deflation of the bag 25 moves the spring 26, which in turn moves the lever 31. For example, when a back pressure inside the cartridge 3 increases during printing, the bag 25 Inflates, causing the lever 31 to release the valve 32, allowing for air and/or ink to enter into the inner volume 18, thereby again increasing the inner pressure and deflating the bag 25 until a certain equilibrium is achieved, which in this embodiment may be a slight back pressure as explained earlier.

In a further embodiment, the bag 25 functions as part of a priming arrangement. The bag 25 may be hyper-inflated for priming, causing a rapid increase of pressure in the inner volume 18 because of the relatively large expansion of the bag 25. The hyperinflation causes air and/or ink to be let out through the respective fluidic interface 16 and/or the print head nozzles. During this priming action, the valve 32 may function as a check valve. Priming may be activated through the first fluidic interfaces 13, 15, that are connected to a pressure fluid supply and/or a pump. The priming action may be activated through the control circuit 7 of the fluid ejection device 1.

In the embodiment described above, the bag 25 actuates a valve 32 through a resilient element 26A and a lever 31, however, in other embodiments the valve 32 may be actuated directly by the bag 25, or directly through one of the resilient element 26A or lever 31, or through other arrangements.

Figure 8:
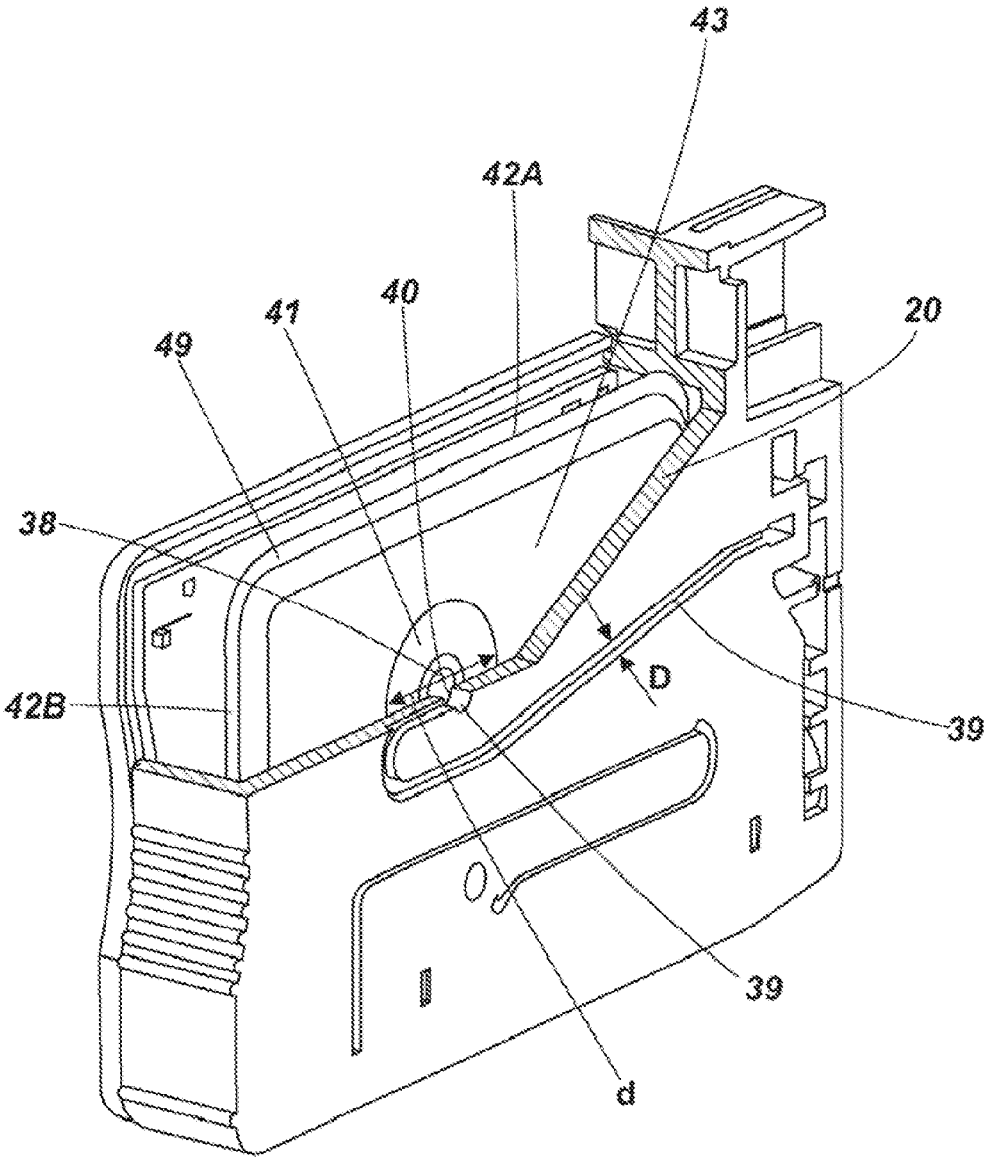
FIG. 8 shows a perspective, partly cross sectional view of the embodiment of a cartridge of FIGS. 5-7, wherein the bag is in a substantially deflated condition.

FIGS. 6 and 7 illustrate further perspective views of the embodiment of FIG. 5. FIGS. 6 and 7 are illustrative for the ease of assembly of the cartridge 3. For example, the cartridge 3 may comprise two shells 36, 37 that when connected enclose the inner volume 18. The shells 36, 37 may comprise molded plastic. The shells 36, 37 may be injection molded. A first shell 36 may comprise the fluidic interfaces 13, 14 and the fluid throughput 33. The first shell 36 may comprise five 19, 20, 22, 23, 24 of the six container walls 19-24 for enclosing the inner volume 18. This allows the cartridge 3 to be side loaded. The first shell 36 may comprise one integrally molded shape including one or more structures for fluidic interfaces, latching, keying, alignment, fitting, other assembly purposes, etc. In an embodiment of a method of assembly, the bag 25 may be placed in the first shell 36. The bag 25 is positioned in the first shell 36 so that its opening 38 is connected to a channel 39 in the cartridge 3 (FIG. 8). The bag 25 may be assembled in deflated condition. The bag 25 is positioned on a substantially planar part of the side wall 20 so that it lies in a substantially flat condition against the side wall 20. The spring 26 may be placed on top of the bag 25. The valve 32 may be placed on top of the third fluidic interface 33. In the shown embodiment, the seal disk 34 is placed on top of the third fluidic interface 33 and the ball 35 is placed on top of the seal disk 34. The lever 31 may be placed on top of the spring 26 and valve 32. The second shell 37 may function as a side lid for placement against the first shell 36 in a final stage of assembly, for enclosing the inner volume 18. The second shell 37 may comprise one 21 of the six container walls 19-24. In the shown embodiment, the second shell 37 comprises one of the side walls 21. The second shell 37 may function as a lid. The second shell 37 may be a closed shell, without fluid openings, for closing the inner volume 18 after the pressure regulation, pressure accumulation and priming features have been positioned in the inner volume 18.

Figure 9:
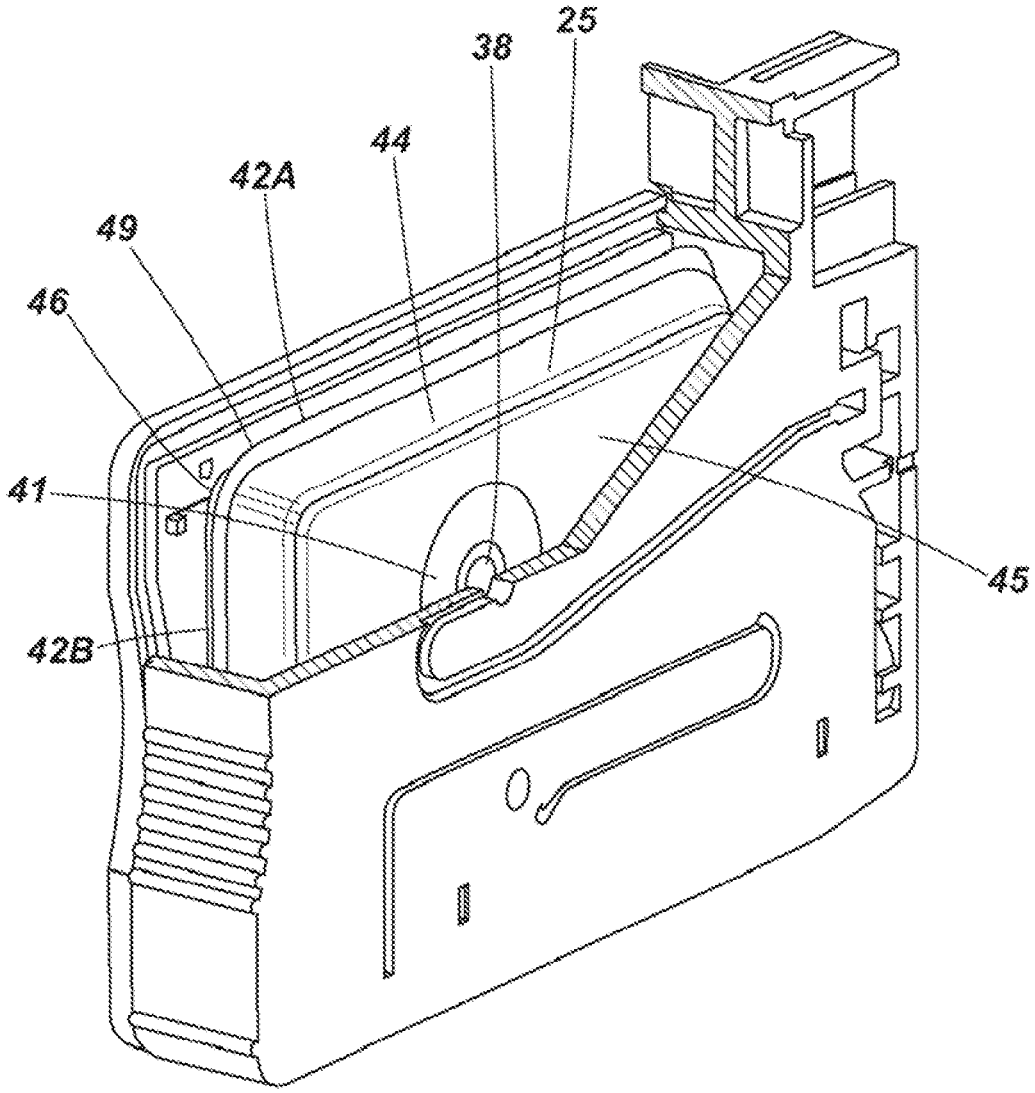
FIG. 9 shows a perspective, partly cross sectional view of the embodiment of a cartridge of FIGS. 5-8, wherein the bag is in a substantially inflated condition.

FIGS. 8 and 9 illustrate an embodiment of the cartridge 3 wherein a part of the first shell 36 is cut out for illustrative purposes. As shown, the bag 25 is provided with an opening 38 for letting the pressure fluid in and out of the bag 25. The cartridge 3 comprises a channel 39 that has a fluidic connection with the opening 38 so that the pressure fluid may flow through the channel 39 and the opening 38. On the other end, the channel 39 is in connection with an exterior of the cartridge, for example with ambient air and/or a pump, for example through the first cartridge fluidic interface 13.

The channel 39 opens into the pressure bag 25. For example, the channel 39 comprises a channel mouth 40 that opens into the inner volume 18. The bag 25 is attached to the cartridge wall 20 so that the opening 38 and the channel mouth 40 overlap. In this way the pressure fluid may be transported between the bag 25 and the exterior of the fluid cartridge 3.

In the shown embodiment, the channel 39 has a longitudinal, longitudinally extended shape, including one or more curves and having a relatively thin diameter. The channel 39 comprises a labyrinth. The channel 39 is arranged to reduce water vapor loss from the bag 25 while allowing gas to flow through. The total length of the channel 39 may be at least approximately 30, or at least approximately 40 times the diameter D of the channel, for example at least 30, or at least 40 times the average diameter D. However, in other embodiments the channel comprises a through opening through the respective cartridge wall 20, for example having a much smaller length vs. diameter ratio.

The bag 25 is attached to the wall 20 in an attachment zone. The attachment zone is the bag and wall surface wherein the bag 25 is attached to the respective wall 20. In the shown embodiment, an attachment feature 41 is provided for attaching the bag 25 to the wall 20. The attachment feature 41 is arranged to attach the bag 25 to the wall 20. The attachment feature 41 is relatively thin. The attachment feature 41 may be a separate feature between the bag 25 and the wall 20, or may comprise a deformation or the like to attach the bag 25 and the wall 20.

In the shown embodiments the attachment feature 41 comprises adhesive. Applying adhesive allows for relatively easy assembly of the bag 25 within the cartridge 3. For example, the bag 25 may be adhered to the substantially planar bottom of the first shell 36, in a flat condition, and with its opening 38 connected to the mouth 40 of the channel 39.

In other embodiments, the attachment feature 41 may comprise a staked, welded, and/or heat sealed attachment. In the process of welding, staking and/or heat sealing the bag 25 and the wall 20 together, the parts 20, 25 may locally melt and join. Multiple suitable welding techniques exist. One form of staking is heat staking, as known in the art.

A relatively thin attachment feature 41 may be provided, for relatively direct attachment to the planar side wall 20, or at least the planar part thereof, aiding in an overall thinner shape of the bag 25 and the whole cartridge 3. In a deflated condition, the substantially flat bag 25 may extend against the planar part of the side wall 20, allowing for more space efficient use, and larger quantities of ejection fluid that may flow relatively freely in the cartridge 3.

The bag 25 is attached to a substantially planar inner surface of the respective side wall 20. The planar inner surface to which the bag 25 is attached is substantially parallel to the direction of insertion Ld of the cartridge 3. The respective wall and bag 25 may be free from special arrangements for attaching the bag 25, such as fitments. The bag 25 may be directly attached against the respective surface of the wall 20, for example by adhesive, staking and/or welding, and may be deflated up to a substantially flat condition against said side wall 20.

In FIG. 6 it can be seen that the bag 25 lies flat against the planar bottom of the first shell 36. This may be made possible by the simple shape of the bag 25. In one embodiment, the bag 25 is directly adhered to the side wall 20, as explained above. In other embodiments, the bag 25 may be welded or staked to the side wall 20. The attachment to the flat side wall 20 and the flat and simple shape of the bag 25 may allow for a thin attachment feature 41. In certain embodiments the attachment feature 41 may comprise a thickness of 2 millimeter or less, or 1 millimeter or less, or 0.5 millimeter or less, or for example approximately 0 millimeter in case the bag 25 is welded or staked to the wall 20. For example, the bag 25 may be attached to the side wall 20 by heat welding or staking.

It is noted that in prior art cartridges with a pressure bag, the attachment features used are fitments and/or special protrusions to attach to the bag to a cartridge wall. For example, during manufacture, first the fitment is attached to the bag, and then the bag is attached to the wall by attaching the fitment to the wall, or to a protrusion extending from the wall.

In contrast, the bag 25 of this disclosure can be attached directly to the flat surface of the side wall 20, using relatively thin attachment features 41, so that said fitments or protruding walls can be left out. The inner wall 20 has a substantially planar surface for attaching the bag 25, instead of specially construed ribs or the like, allowing for a simpler construction. In turn, inner volume 18 is gained for containing relatively more ink within the cartridge 3. The cartridge 3 is relatively thin. The bag 25 may have a relatively flat and simple shape because fitments for attaching the bag to the wall may be redundant due to the relatively simple attachment features 41 proposed in this disclosure. Furthermore, the side wall 20 may be relatively flat because of the direct attachment of the bag 25 by the attachment feature 41, in turn made possible by the simple shape of the bag 25. Moreover, as a result of the relatively flat shape of the bag 25 extending along the wall 20 to which it is attached, undesirable interaction between the second fluid and the attachment feature 41 may be prevented because the fluid is prevented from flowing between the bag 25 and the wall 20.

In further embodiments, the bag 25 is attached to the side wall 20 by a combination of adhesive and one of a welding and staking feature. This may provide for a better attachment, for example in case of relatively aggressive inks.

An embodiment of an adhesive comprises PSA (Pressure Sensitive Adhesive). PSA bonds by applying pressure to it. The bag 25 can be attached relatively fast and easy by using the PSA. It also appeared that the PSA and ejection fluid may be relatively compatible. In an embodiment, the ejection fluid and the PSA do not negatively interact during an average lifetime of the cartridge 3. Interaction between the PSA and the ejection fluid may be reduced because the flat surface 43 of the bag 25 extends along and at least partly engages the planar surface of the respective cartridge wall 20. Multiple PSA embodiments are suitable. One example of a PSA comprises acrylic and rubber components. Non-PSA embodiments may also be suitable, such as certain Ultraviolet cured adhesives and/or Radiofrequency and/or microwave cared adhesives.

The bag 25 is attached to the wall 20 near and around the channel mouth 40. The applied attachment feature 41 may be applied to form a ring shaped attachment zone, extending around the channel mouth 40 and opening 38. By applying the attachment feature 41 around the mouth 40, a substantially fluid tight connection may be maintained between the bag 25 and the wall 20. In certain embodiments, the attachment zone extends exclusively near the channel mouth 40 and left away from a circumferential edge zone 44. FIG. 9 illustrates an example of a circumferential edge zone 44 in a partly inflated and globed condition. The circumferential edge zone 44 extends along the circumferential bag edges 42A-D. The circumferential edge zone 44 is the circumferential bag portion that at least partly globes when inflated.

By attaching the bag 25 to the wall 20 near the mouth 40 and/or opening 38, ejection fluid may be kept away from the attachment zone, because little or no ejection fluid may flow between the bag film 45 that extends against or near the side wall 20. By having the attachment zone away from the edges 42A-D, it may be prevented that the bag 25 peels off during inflation, especially near the circumferential edge zone 44, and when hyper-inflating. In an embodiment, by applying the adhesive near the mouth 40 and/or opening 38 the adhesive may be pressed against the wall 20 at inflation.

In one embodiment, the outer diameter d of the attachment zone, as formed by the attachment feature 41 (see FIG. 8) is approximately 20 millimeter or less, or for example approximately 16 millimeter or less. In one embodiment the outer diameter d of the attachment feature 41 is approximately 13 millimeters for attaching a bag having a height or width of approximately 34 millimeter, wherein the height or width of the bag 25 is the distance between to opposite edges 42A-D of the bag 25. For example the outer diameter d of the attachment feature may be approximately 40% or less of the total height or width of the bag 25.

The bag 25 may basically comprise two films 45, 46 that are attached together near the circumferential edges 42A-D. The films 45, 46 may be staked together, for example heat staked, near the edges 42A-D. One of the films 46 may have been provided with the opening 38 before attaching the films 45, 46. The staked bag 25 has a circumferential stake seam edge 49. In another embodiment, the bag 25 is formed of one film 45 that is folded and then staked.

Figure 10B:
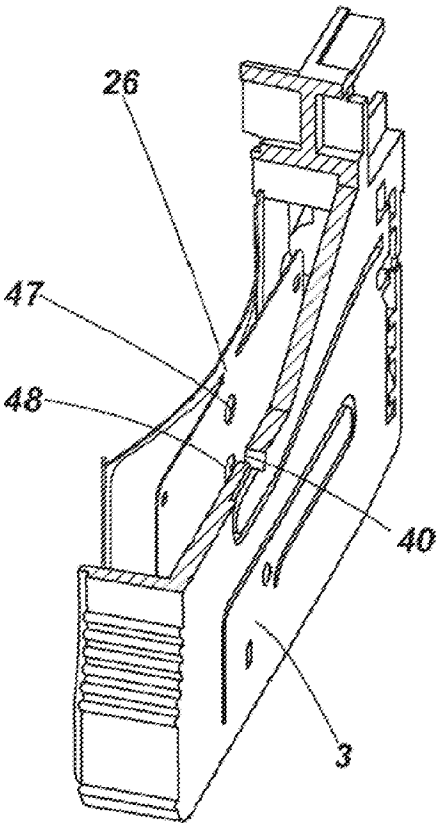
FIG. 10B shows a perspective, cross sectional view, of the embodiment of FIG. 10A from a different viewpoint.
Figure 10A:
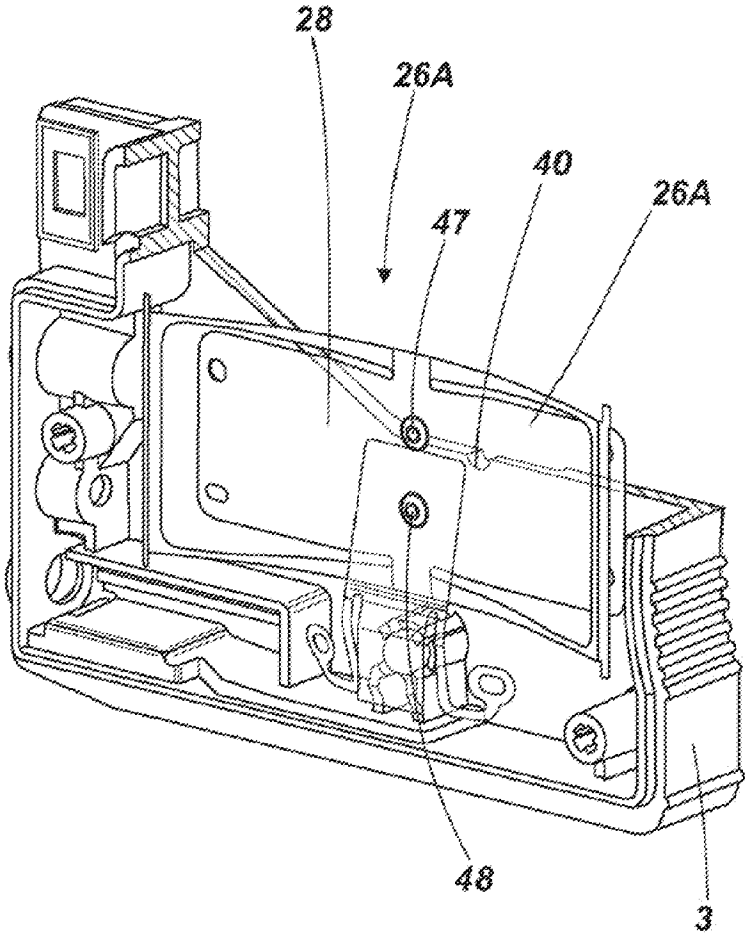
FIG. 10A shows a perspective, cross sectional view, of an embodiment of a cartridge including a leaf spring with depressions, wherein the spring is made transparent and the bag is left out for illustrative reasons.

As illustrated by FIGS. 10A and 10B, to facilitate a relatively free flow of pressure fluid into and out of the bag 25, the resilient element 26A may comprise depressions 47, 48 in the engagement surface 28 that in assembled condition extend near the opening 38 of the bag 25, and the mouth 40 of the channel 39. The depressions 47, 48 may prevent that air remains in the bag 25 because the engagement surface 28 presses the films 45, 46 together and blocks the opening 38. This could occur when the bag 25 is largely or completely deflated. Other known bags are provided with particular internal bleed features that prevent such from happening. In this disclosure, an internal bleed feature need not be required because of the depressions 47, 48. The depressions 47, 48 may comprise one, two, three or more relatively small dimples, close to the mouth 40. In the shown embodiment, two dimples are provided extending relatively close to the mouth 40 to aid in free flow of pressure fluid to and out of the bag 25.

Figure 11:
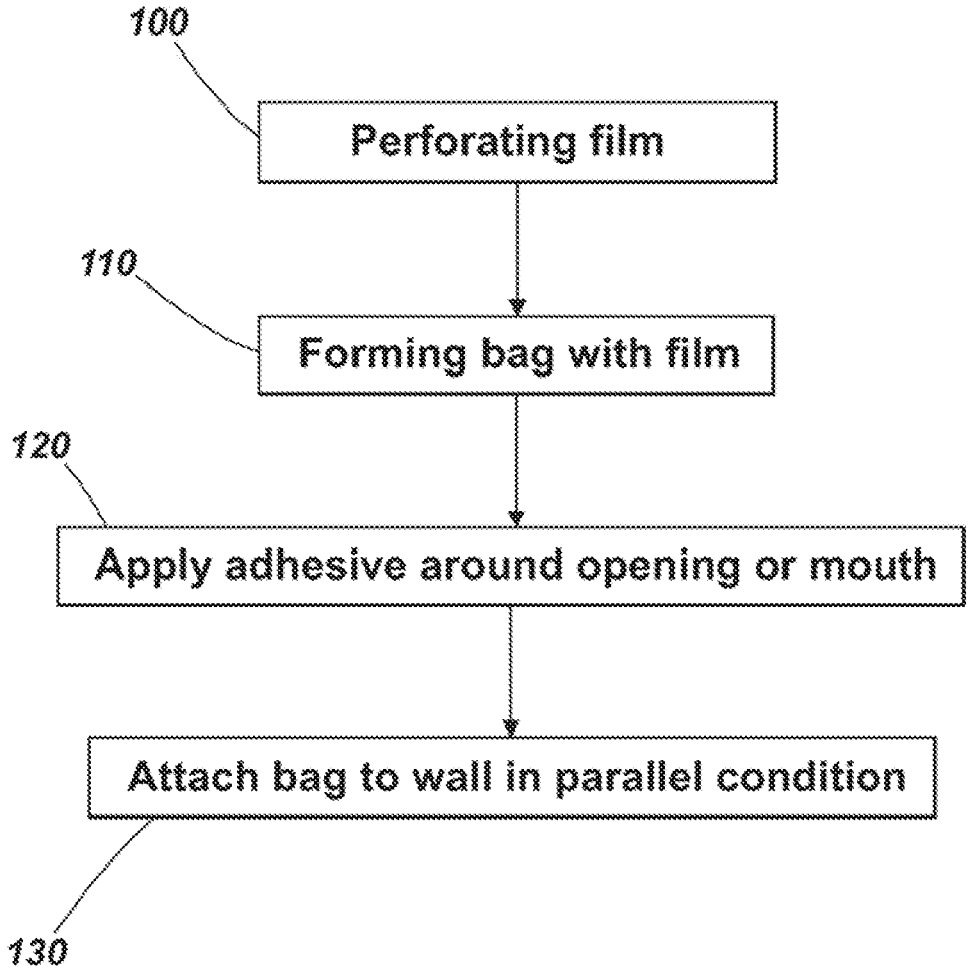
FIG. 11 shows a flow chart of an embodiment of a part of a method of manufacturing a cartridge.

FIG. 11 shows an embodiment of a method of manufacturing a fluid cartridge 3 by means of a flow chart. The steps of manufacturing and attaching a pressure bag 25 in the cartridge 3 are shown. In a step 100, a film 45 is perforated so that an opening 38 is formed in the film 45 (FIG. 13A). 45 The film 45 may be ribbon shaped. The films 45 may comprise plastic films, for example polypropylene, polyethylene, or another suitable relatively impermeable plastic. The film 45 is then used to form a bag 25, as indicated by step 110. For example, a second film 46 is attached to the first film 45 and the bag 25 is cut out. In an embodiment, the attachment feature 41 comprises a stake, weld or adhesive feature. In an embodiment, just one film is folded and the edges are closed off to form the bag 25.

As indicated by step 120, the attachment feature 41 is applied around the opening 38 or around the mouth 40 of the channel 39. In one embodiment, adhesive is applied around the mouth 40. In a further embodiment, the adhesive is applied around the opening 38. In again another embodiment, adhesive is applied around both. In other embodiments, the bag 25 is staked or welded to the wall 20.

The bag 25 is attached to a cartridge inner wall 20 wherein the bag film 45 extends parallel to the planar part of the inner wall 20. The bag 25 is attached to the wall 20 so that the opening 38 is in open connection with the channel 39. The attachment feature 41 attaches the bag 25 to the wall 20 around the mouth 40 of the channel 39, as indicated by step 45.

Figure 12:
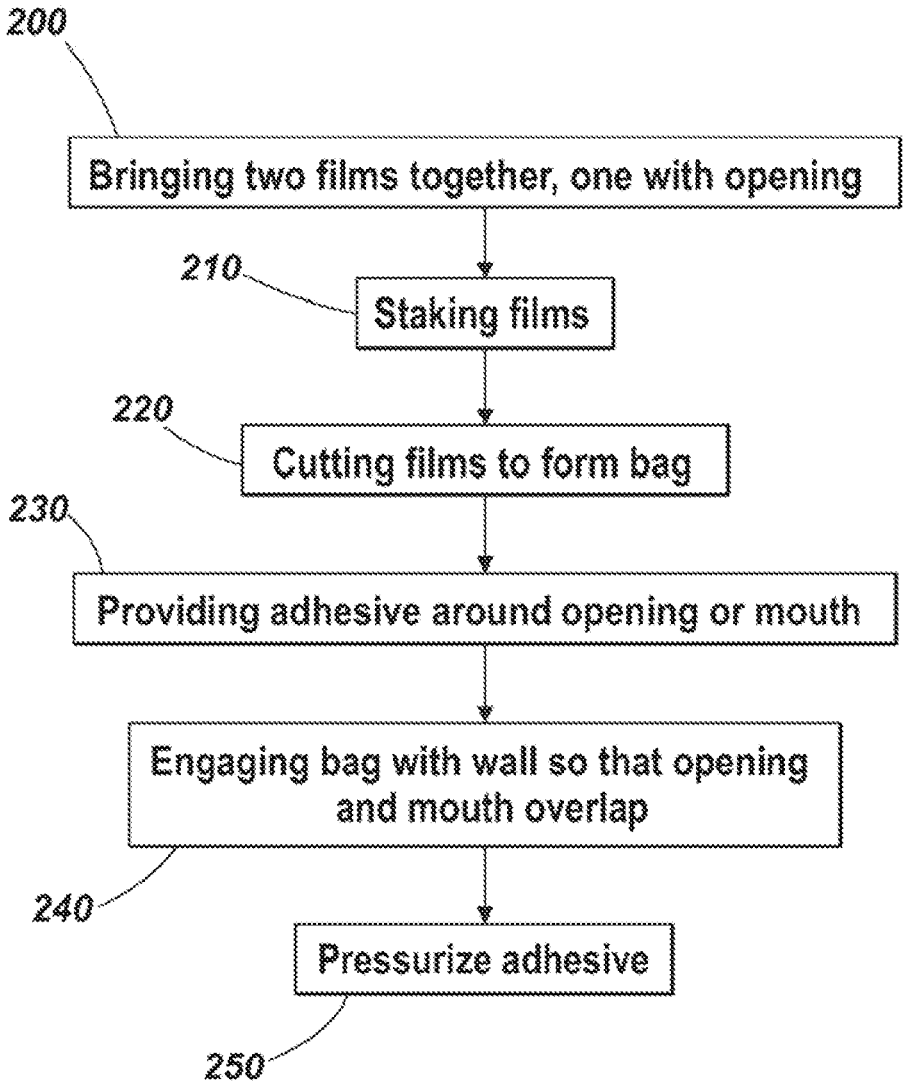
FIG. 12 shows a flow chart of a further embodiment of a part of a method of manufacturing a cartridge.
Figure 13A:
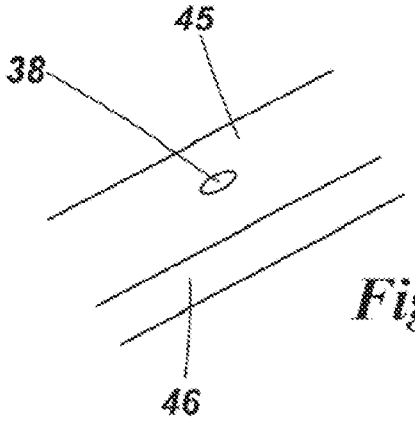
FIG. 13A-C diagrammatically visualize three phases the method of manufacturing a cartridge pressure bag, corresponding to FIG. 12.
Figure 13B:
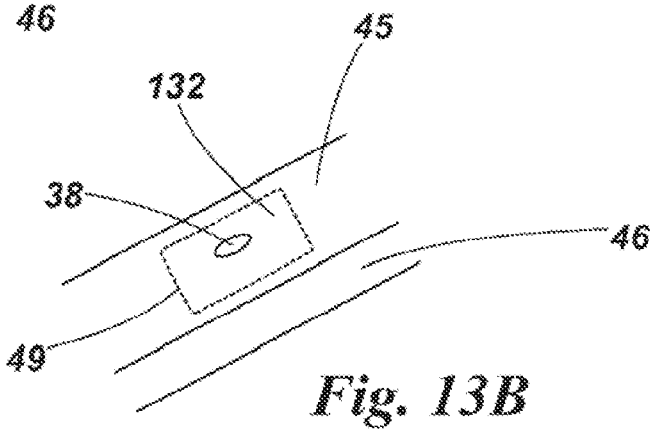
Figure 13C:
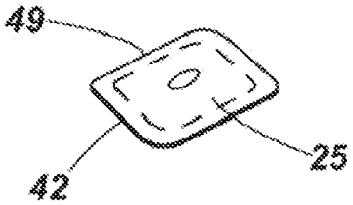

FIG. 12 shows a further embodiment of a method of manufacturing a fluid cartridge 3, by means of a flow chart. FIG. 13A-C schematically illustrates certain phases of the bag formation, corresponding flow chart of FIG. 12. In a first step 200, a film 45 is provided. The film 45 is perforated providing for an opening 38. Another film 46 Is provided that may have approximately a similar size as the first film 46. The two films 45, 46 are positioned in parallel (see FIG. 13A). In a next step 210, the films 45, 46 are staked (FIG. 13B). The films 45, 46 are staked to form circumferential edges 42 of the bag 25. The staked seams 49 form a pocket 132 in the films 45, 46. In similar embodiments, the films 45, 46 may be glued, sealed or welded together to form a pocket 132. In a step 220, the films 45, 46 are cut around the staked seams 49, forming the circumferential bag edge 42, so that the bag 25 can be taken out of the films 45, 46. In an embodiment, the bag 25 may be staked and cut at the same time. As can be seen from FIG. 13C, the pressure bags 25 may be ready to be placed in the cartridge 3.

In step 230, adhesive is provided around one of the opening 38 and the mouth of the channel 39. For example, the adhesive is applied around the mouth 40. In step 240, the bag 25 is engaged with the wall 20 so that the opening 38 of the bag 25 and the mouth 40 of the channel 39 overlap. In this way, the inside of the bag 25 is in open communication with the channel 39. In a step 250, the adhesive is pressurized between the bag 25 and the wall 20. For example, the bag 25 is pressed against the cartridge wall 20. In an embodiment, the adhesive comprises PSA, and the PSA is pressurized until it bonds. The resulting PSA feature may be approximately 0.5 millimeters thick, or thinner. In a further embodiment, the adhesive is applied exclusively near and around at least one of the mouth 40 of the channel 39 and the opening 38, and not near the circumferential edge zone 44 of the bag 25.

In further steps, as already explained above with reference to FIGS. 6 and 7, further parts, such as pressure regulating and accumulating parts, such as resilient elements 26 and valve parts, are assembled in the cartridge 3.

Figure 14:
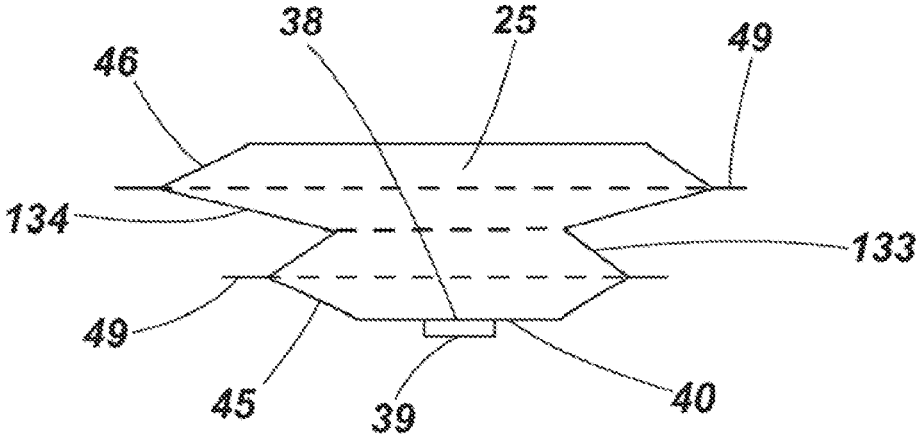
FIG. 14 shows a diagrammatic cross sectional front view of an embodiment of a pressure bag and opening.

The bag 25 may comprise more than two films 45, 46. FIG. 14 schematically shows an embodiment of a bag 25 with four films 45, 133, 134, 46. The bag 25 may have multiple stake seams 49. In a further embodiment, one stake seam 49 is larger than another stake seam 49, to facilitate easier staking. For example the bag 25 may comprise a bellows, to be inflated and deflated as a bellows. In one embodiment, the bag 25 comprises two or more bags 25, of which one bag comprises two opposite openings 38 to transport pressure fluid between the other bag and the channel 39.

The fluid cartridge 3 may be used for providing controlled quantities of fluid to a print head 4 or other type of ejector. In certain embodiments, the fluid may comprise a liquid or gas, to be connected to any type of fluid ejection device 1, not necessarily a printer. For example, the fluid ejection device 1 may be any type of fluid dispense or administration device, wherein the fluid may for example be a pharmaceutical substance.

The bag 25 and manufacturing methods as explained above may facilitate smaller and thinner fluid cartridges 3 since fitments and ribs in the inner volume 18 of the cartridges 3 may be reduced. Leaving out fitments from the bag 25 may also provide longer spring 26 and bag 25 travel, and subsequently, better pressure control. Fuller inflation and deflation may be achieved within a relatively thin cartridge inner volume. This may be a step forward since conventionally thinner cartridge volumes used a foam type pressure mechanisms instead of pressure bag mechanisms.

Moreover, because of the simple bag shape and a reduction of fitments, the complexity and number of parts of the cartridges 3 may be reduced, thereby reducing costs of construction, shipment and storage. The bags 25 may be produced through planar films 45, 46, which would be difficult to achieve if fitments were attached. The adhesive may allow for simple and low cost installation of the bag 25.

Certain embodiments of the bag 25 can be manufactured and installed at relatively low cost. Certain embodiments of the bag 25 showed to be suitable for hyper-inflation for performing a priming function. The bag 25 showed a good accumulator function, allowing easy expansion and contraction, at different temperature and pressure circumstances. While more complex prior art bags may show more hysteresis, the relatively simple bag shape and the planar attachment wall 20 presented in this disclosure may show little or no hysteresis, as compared to some prior art bags. Also, the simple bag construction provides a relatively wide range of options for the bag film material, so that a film 45 can be chosen that has a good compatibility with ink.

Furthermore, because the wall 20 and bag 25 are relatively flat, ejection fluid may be relatively free to slosh, which may prevent settling of the ejection fluid. The bag 25 may flatten substantially completely because of the simple shape of the bag 25 and the substantially planar surface of the wall 20 to which it is attached, facilitating efficient use of the inner volume 18. The flat construction of the side wall 20 allows for the long, thin shaped channel 39 to extend within the side wall 20.

In one aspect of the invention, a fluid cartridge 3 is provided, that may comprise an inner volume 18 for holding a fluid, defined by inner walls 19-24, a pressure bag 25 in the inner volume 18, for containing a pressure fluid, comprising a film 45, 46, and a channel 39 arranged in the cartridge wall 20, comprising a channel mouth 40 opening into the pressure bag 25, for transporting pressure fluid between the bag 25 and an exterior of the fluid cartridge 3, wherein the bag film 45 is attached to a substantially planar inner wall 20, around the channel mouth 40, the attached bag film portion extending parallel to the inner wall 20. In an embodiment, in a deflated condition of the pressure bag 25, the bag 25 extends substantially parallel to a planar surface of said inner wall 20. In an embodiment, the attachment feature 41 for attaching the bag 25 to said inner wall 20 has a thickness of approximately 2 millimeter or less, for example approximately 1 millimeter or less, or for example approximately 0.5 millimeter or less. In an embodiment, the bag 25 and said substantially planar inner wall 20 are attached along an attachment zone. This attachment zone may extend exclusively around the mouth 40 of the channel 36, and not in a circumferential edge zone 44 of the bag 25, which globes in an inflated condition of the bag 25, so that tension in the attachment zone is prevented. In a further embodiment, the attachment feature 41 comprises adhesive, for example PSA (pressure sensitive adhesive). In again a further embodiment, a resilient element 26A extends within the inner volume 18. In an embodiment, the resilient element 26A has a relatively flat engagement surface 28 that engages the pressure bag 25 for pressing the pressure bag 25 towards deflation, without being attached to the pressure bag 25. In an embodiment, the cartridge 3 has a relatively thin outer shape with a length versus width ratio of at least approximately 4:1. In an embodiment, the fluid cartridge 3 is an ink cartridge for connection to an inkjet printer, the fluid in the inner volume 18 comprising ink, and the fluid in the pressure bag 25 comprising air.

In a further aspect, a method of manufacturing a fluid cartridge 3 is provided. The method may comprise perforating a film 45 to form an opening 38, forming a bag 25 with said film 45, and attaching the bag film 45 to a substantially planar inner wall 20, parallel to the substantially planar inner wall 20, so that the opening 38 is in open connection with a fluid channel 39 in the wall 20 and the bag film 45 is attached to the wall 20 around the opening 38. In an embodiment, the method comprises attaching the bag 25 exclusively near and around at least one of the mouth 40 of the channel 39 and the opening 38, and not in a circumferential edge zone 44 of the bag 25 that globes in an inflated condition of the bag 25, so that tension in an attachment zone 41 is prevented. In a further embodiment, the method comprises attaching the bag 25 to the wall 20 by an attachment feature 41 having a thickness of 2 millimeters or less, for example by adhesive such as PSA. In again a further embodiment, the forming of the bag 25 comprises providing at least two films 45, 46 parallel to each other, wherein one film 45 comprises an opening 38, staking a circumferential edge 42, 49 in the films 45, 46 so as to form a pocket 132 between the films 45, 46, and cutting the pocket 132 out of the films 45, 46, around the staked edge 42, 49.

In again a further aspect, a fluid cartridge may be provided, comprising inner walls 19-24, forming an inner volume 18 for ejection fluid, a pressure bag 25 extending in the inner volume 18, attached to one of the inner walls 19-24, the pressure bag 25 being attached so that in a deflated condition the bag 25 is relatively flat and extends with its flat side surface 43 against, and parallel to, a planar part of the inner wall 20 to which it is attached.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. The indefinite article "a" or "an" does not exclude a plurality, while a reference to a certain number of elements does not exclude the possibility of having more elements. A single unit may fulfil the functions of several items recited in the disclosure, and vice versa several items may fulfil the function of one unit.

In the following claims, the mere fact that certain measures are recited in mutually different dependent claims does not indicate that a combination of these measures cannot be used to advantage. Multiple alternatives, equivalents, variations and combinations may be made without departing from the scope of the invention.

The invention claimed is:

1. A fluid cartridge, comprising an inner volume for holding a fluid, the inner volume defined by inner walls, a pressure bag in the inner volume for containing a pressure fluid, the pressure bag comprising at least two films, the at least two films being staked around a circumferential edge to form a pocket between the at least two films, and a channel arranged in an inner wall of the cartridge, comprising a channel mouth for transporting pressure fluid between the pressure bag and an exterior of the fluid cartridge, wherein the pressure bag is attached to the inner wall around the channel mouth, the pressure bag comprising an opening defined therein, wherein the pressure bag and said inner wall are directly attached along an attachment zone radially surrounding the opening, the attachment zone extending exclusively around the mouth of the channel, and not to a circumferential edge of the bag.

2. The fluid cartridge according to claim 1, wherein the attachment zone comprises a thickness of 2 millimeters or less.

3. The fluid cartridge according to claim 1, wherein the attachment zone does not extend in the circumferential edge of the bag that globes in an inflated condition of the bag, so that tension in the attachment zone is prevented.

4. The fluid cartridge according to claim 1, comprising a resilient element extending within the inner volume, having a relatively flat engagement surface that engages the pressure bag for pressing the pressure bag towards deflation, without being attached to the pressure bag.

5. The fluid cartridge according to claim 1, having a relatively thin outer shape with a length versus width ratio of at least 4:1.

6. The fluid cartridge according to claim 1, the fluid cartridge forming an ink cartridge for connection to an inkjet printer, the fluid in the inner volume comprising ink, and the fluid in the pressure bag comprising air.

7. A fluid cartridge according to claim 1, wherein said channel extends through and within said cartridge wall to a fluidic interface on a front portion of said fluid cartridge, said front portion of the fluid cartridge also comprising a fluidic interface from which the fluid from said inner volume is discharged from the fluid cartridge during printing operations.

8. The fluid cartridge of claim 1, in which a portion of the pressure bag does not enter the channel.

9. The fluid cartridge according to claim 1, wherein the bag is attached to the wall by adhesive.

10. The fluid cartridge according to claim 9, wherein the adhesive comprises pressure sensitive adhesive.

11. A fluid cartridge according to claim 1, further comprising:

a valve controlling a fluidic interface for allowing a fluid into the inner volume, wherein the valve is operated by the pressure bag as the pressure bag inflates and deflates.

12. A fluid cartridge according to claim 11, further comprising a lever connected to said valve, wherein said lever is engaged by and moved by inflation of said pressure bag so as to actuate said valve.

13. A method of manufacturing a fluid cartridge, comprising:

providing at least two films, perforating one of said films to form an opening, forming a bag with said films by staking the two films together around a circumferential edge so as to form a pocket between the films, and attaching a first one of the films of said bag having said opening to a substantially planar inner wall of said fluid cartridge, so that the opening is in open connection with a fluid channel in the inner wall and the film of the bag is attached to the inner wall around the opening, in which the first film and said inner wall are directly attached along an attachment zone, the attachment zone extending exclusively around the mouth of the channel, and not in the circumferential edge of the bag, so that tension in the attachment zone is prevented.

14. The method according to claim 13, wherein the attachment zones comprises a thickness of 2 millimeters or less.

15. The method according to claim 13, the forming of the bag further comprising cutting the pocket out of the films, around the staked circumferential edge.

16. The method according to claim 13, comprising attaching the bag to the inner wall by adhesive.

17. The method according to claim 16, wherein the adhesive is a pressure sensitive adhesive, comprising pressurizing the adhesive between the film and the inner wall.

18. A fluid cartridge, comprising inner walls forming an inner volume for containing an ejection fluid, a pressure bag extending in the inner volume attached to a first one of the inner walls, the pressure bag comprising at least two films, the at least two films being staked around a circumferential edge to form a pocket between the at least two films, in which the pressure bag is attached so that in a deflated condition the pressure bag is relatively flat and extends with its flat side surface against, and parallel to, a planar part of the first inner wall to which it is attached, and a channel defined in the first inner wall comprising a channel mouth opening into the pressure bag via an opening defined in the pressure bag, for transporting pressure fluid between the pressure bag and an exterior of the fluid cartridge, wherein the pressure bag and first inner wall are directly attached along an attachment zone radially surrounding the opening, the attachment zone extending exclusively around the channel mouth, and not to the circumferential edge of the pressure bag that globes in an inflated condition of the bag.

19. A fluid cartridge according to claim 18, further comprising:

a valve controlling a fluidic interface for allowing a pressure fluid into the inner volume, the valve operating by the pressure bag as the pressure bag inflates and deflates;

a lever connected to said valve, wherein said lever is engaged by and moved by inflation of said pressure bag so as to actuate said valve.

20. A fluid cartridge according to claim 18, wherein the channel has a longitudinal shape and comprises at least one curve along its length so as to reduce water vapor loss from inside the pressure bag.

* * * * *